US006318062B1

(12) United States Patent
Doherty

(10) Patent No.: US 6,318,062 B1
(45) Date of Patent: Nov. 20, 2001

(54) RANDOM LAY WIRE TWISTING MACHINE

(75) Inventor: John Doherty, Pearl River, NY (US)

(73) Assignee: Watson Machinery International, Inc., Paterson, NJ (US)

( * ) Notice: Subject to any disclaimer, the term of this patent is extended or adjusted under 35 U.S.C. 154(b) by 0 days.

(21) Appl. No.: 09/191,690

(22) Filed: Nov. 13, 1998

(51) Int. Cl.[7] ..... D01H 7/86

(52) U.S. Cl. ..... 57/58.65; 57/92; 57/58.49; 57/58.52; 57/58.67; 57/58.65; 57/206; 57/237; 57/264

(58) Field of Search ..... 57/58.49, 58.52, 57/58.63, 58.65, 58.67, 58.68, 93, 206, 237, 264; 174/113 R

(56) References Cited

U.S. PATENT DOCUMENTS

| | | | |
|---|---|---|---|
| Re. 26,757 | 1/1970 | Vibber | 57/58.3 |
| 267,279 | 11/1882 | Strohm . | |
| 297,175 | 4/1884 | Shelbourne . | |
| 1,629,168 | 5/1927 | Massingham . | |
| 1,684,511 | 9/1928 | O'Donnell | 57/58.68 |
| 2,002,975 | 5/1935 | Brooks | 57/58.52 |
| 2,010,888 | 8/1935 | Pool | 57/58.52 |
| 2,723,525 | 11/1955 | Blaisdell | 57/58.36 |
| 2,773,344 | 12/1956 | Van Hook | 58/58.65 |
| 2,787,653 | 4/1957 | Ormerod . | |
| 2,958,724 | 11/1960 | Milloit . | |
| 3,052,079 | 9/1962 | Henning . | |
| 3,067,569 | 12/1962 | Kelley, Jr. . | |
| 3,142,952 | 8/1964 | Krafft et al. | 57/58.7 |
| 3,147,580 | 9/1964 | Blaisdell et al. | 57/58.7 |
| 3,382,314 | 5/1968 | Nordblad . | |
| 3,676,576 | 7/1972 | Dubernet . | |
| 3,715,877 * | 2/1973 | Akachi | 57/156 |
| 3,732,682 * | 5/1973 | Crotty et al. | 57/59 |
| 3,857,996 | 12/1974 | Hansen . | |
| 4,006,582 * | 2/1977 | Gurkaynak et al. | 57/34 AT |
| 4,100,721 | 7/1978 | Seiichi . | |
| 4,102,117 * | 7/1978 | Dornberger | 57/93 |

(List continued on next page.)

FOREIGN PATENT DOCUMENTS

| | | |
|---|---|---|
| 0299123 A2 | 1/1989 | (EP) . |
| 2542545 | 9/1993 | (JP) . |
| 8-6269 | 12/1994 | (JP) . |
| 2717396 | 6/1997 | (JP) . |

*Primary Examiner*—William Stryjewski
(74) *Attorney, Agent, or Firm*—Weingram&Associates, PC

(57) ABSTRACT

A wire twisting machine and method provide a randomly varying lay to pairs of twisted wires forming a cable. A pair of wires are fed into a motor driven bow mechanism which twists the wires at a given rate of speed. The bow winding speed is sensed to provide a signal to a control system employing a computer which generates a randomly varying signal between a selected minimum and maximum range. The random signal is applied to an oscillator which provides a varying frequency signal to a power supply unit. A pulsed direct voltage signal then controls a stepping motor which applies the randomly varying lay signal to vary the speed of the capstan winding the wires with respect to the independent bow speed. This varies the length of lay of the twisted wires within controlled limits.

14 Claims, 3 Drawing Sheets

U.S. PATENT DOCUMENTS

| | | | | |
|---|---|---|---|---|
| 4,133,167 | | 1/1979 | Schofield | 57/12 |
| 4,182,105 | | 1/1980 | Tokuji . | |
| 4,222,221 | | 9/1980 | Lenorak | 57/58.49 |
| 4,227,041 | | 10/1980 | Den et al. . | |
| 4,300,339 | | 11/1981 | Orlandi et al. | 57/58.34 |
| 4,328,662 | | 5/1982 | Bretegnier et al. | 57/58.65 |
| 4,381,426 | * | 4/1983 | Cronkite et al. | 174/117 F |
| 4,404,424 | | 9/1983 | King et al. . | |
| 4,413,469 | * | 11/1983 | Paquin | 57/293 |
| 4,445,593 | | 5/1984 | Coleman et al. . | |
| 4,446,688 | | 5/1984 | Ueda | 57/58.65 |
| 4,461,923 | | 7/1984 | Bogese . | |
| 4,486,623 | | 12/1984 | Ploppa . | |
| 4,545,190 | | 10/1985 | Rye et al. | 57/212 |
| 4,570,428 | | 2/1986 | Blackmore | 57/58.65 |
| 4,604,862 | * | 8/1986 | McGettigan et al. | 57/264 |
| 4,654,476 | | 3/1987 | Ottler . | |
| 4,677,256 | | 6/1987 | Bauer et al. . | |
| 4,680,423 | | 7/1987 | Bennett et al. . | |
| 4,734,544 | | 3/1988 | Lee . | |
| 4,754,102 | | 6/1988 | Dzurak . | |
| 4,759,487 | | 7/1988 | Marlinski . | |
| 4,777,325 | | 10/1988 | Siwinski . | |
| 4,937,401 | | 6/1990 | Lee . | |
| 4,945,189 | | 7/1990 | Palmer . | |
| 5,118,278 | | 6/1992 | Nishijima et al. | 425/500 |
| 5,287,691 | | 2/1994 | Okamato . | |
| 5,424,491 | | 6/1995 | Walling . | |
| 5,493,071 | | 2/1996 | Newmoyer . | |
| 5,622,039 | * | 4/1997 | Thompson | 57/3 |
| 5,767,441 | | 6/1998 | Brorein . | |
| 5,966,917 | * | 10/1999 | Thompson | 57/58.49 |

* cited by examiner

RANDOM LAY WIRE TWISTING MACHINE

BACKGROUND OF THE INVENTION

Field of the Invention

The present invention relates to a wire twisting machine, wire construction and method which provides a randomly varying lay of a twisted pair of wires over a given length or time. This improves the electrical characteristics of the final cable construction.

The problem of interference of random noise between insulated wires in runs of communication wires and cables has always been a problem. As the need for more and more cabling has increased, it is necessary to run more and more wires within given conduits or in bundles formed for purposes of transporting data and information. This has become even more important in recent years as the frequencies used in connection with wires for telecommunications and computer applications have increased and therefore the chances of leakage or contamination of information passing between adjacent wires has become ever greater.

In order to minimize problems resulting from the closeness of the wires and to facilitate the handling of long lengths of wires, the wires are generally twisted in pairs or numbers greater than two to form cables. However, it is important that the wires not be in a close parallel relationship for any substantial length in order to minimize the possibility of contamination or noise from one wire effecting another wire.

Therefore, efforts are made in the manufacturing of wire to insure that different lays of wire are placed alongside each other for pairs of wires so that there can be no intertwining between groups of twisted wires which would exacerbate any cross contamination problems. Various different attempts have been made to accomplish this purpose. For example, when forming cables of various numbers of pairs, care is taken to insure that the lay length of each pair of wires is different to reduce the effects of proximity between the various pairs. Similarly, efforts in the past have attempted to vary the length of the lay along the path of the wire, but this has generally not proved to be easy to accomplish.

Various different machines have been provided for winding wires, but none of these machines have been able to produce a randomly varying length of lay or twist pitch in the wire.

DESCRIPTION OF THE PRIOR ART

A variety of apparatus for twisting strands of fiber and wire have been utilized in the past and are presently employed. Examples of such known devices are shown in the following prior patents and publications.

U.S. Pat. No. 1,684,511 to O'Donnell discloses a strand-twisting apparatus for cotton, consisting of a pair of flyer bows and twisting member which coact to form two complete twists in the cotton core and the tinsel served threads for each revolution of the flyer.

U.S. Pat. No. 2,002,975 to Brooks discloses twisted strands and a method of producing same consisting of a twisting frame and a plurality of reels to produce a strand consisting of a flat and at least one round wire twisted together.

U.S. Pat. No. 2,010,888 to Pool discloses a method for doubling yarns, threads, or filaments utilizing a pair of flyer tubes wherein one of the threads is provided with an added twist during the drawing operation, and the other of the threads has not been twisted during the operation and is doubled with the thread drawn with the twist. The degree of doubling is dependent upon the rate of take-up which is adjustable relative to the rate of twisting. This variation is selectable from a low to a high degree.

U.S. Pat. No. 2,734,525 to Blaisdell discloses a wire twisting machine consisting of a flyer section with a rotatable tubular shaft at one end thereof and within which a wire strand passes relative to the flyer section to be guided along a shaft in which a plurality of rotatable rollers thereon engage the strand as it passes through the guide for alignment of the wires prior to twisting.

U.S. Pat. No. 2,773,344 to Van Hook discloses a vertical twisting machine consisting of three flyer arms and a capstan unit pivoted at its upper end proximate to a cradle for the flyer bows, whereby the capstan may be swung about the pivotal axis for changing the gears of the apparatus to vary the lay of the product.

U.S. Pat. No. 3,142,952 to Krafft et al discloses a stranding apparatus consisting of an endless belt mounted on the flyer for the cable and revolving therewith, in combination with means for driving the belt at approximately the same speed as the speed of the advancement strand. The belt prevents excess tension on the strand during the winding operation.

U.S. Pat. No. 3,147,580 to Blaisdell et al discloses controlling means for a double twist wire machine consisting of first and second responsive means connected to the flyer for the apparatus to feed a precise length of wire required to make each layer of concentric double twist strand, and to also act as a means for controlling the speed of the take-up reel to produce a uniform twist.

U.S. Pat. No. RE 26,757 to Vibber discloses an apparatus for twisting and plying strands consisting of a mechanism for controlling the rotating loop or balloon of a twisting mechanism. Means responsive to variations in tension of the second strand are provided for varying the speed of rotation of a shaft for the strand for twisting together evenly two strands of two-ply cord.

U.S. Pat. No. 4,133,167 to Schofield discloses a cable making machine consisting of separate machine sections for lapping and twisting so that the machine can be used selectively therefor, or for both twisting and lapping. Common drive means are used for the machine including a conventional clutch for isolating the drive to the lapping section when required.

U.S. Pat. No. 4,222,221 to Lenorak discloses a winding machine with a multitwist spindle for textile working of fibers and yarn consisting of a multitwist spindle rotatably mounted on the supporting frame and a winding-on means synchronized with respect to each other.

U.S. Pat. No. 4,300,339 to Orlandi et al discloses a system for stranding and cabling elongate filaments. A plurality of modules is adapted for end-to-end alignment, each of the modules supporting supply reels which elongate filaments that are drawn off and guided to a rotating flyer guide to cause the stranding of the filaments to the next successive module.

U.S. Pat. No. 4,328,662 to Bretegnier et al discloses a multiple twisting machine for high speed helical winding of unitary strands to form a cable. The machine consists of central and external frames and drive means therefor, for reversing rotation and driving the frames in opposite directions at substantially the same speed. One of the frames is driven by pulleys at its ends and includes plates connected by a stretch-taut rope which guides the cable over a path to be twisted.

U.S. Pat. No. 4,446,688 to Ueda discloses a double twisting machine consisting of two motors for directly and separately driving each end of a flyer which thereby eliminates the need for a drive shaft, driving pulleys and timing belts for the apparatus.

U.S. Pat. No. 4,545,190 to Rye et al discloses a metallic cable, method and apparatus for making same, wherein the cable consists of strands of identical shaped filaments positioned beside and against each other such that each filament of the strand is in line and in contact with at least one filament of the strand. A series of "kill rolls", freely rotating pulleys, mechanically deform the filaments of a strand or cable to permanently fix the position of the filaments with respect to one another and relieve the stresses in the strand or the cable. The helixes of the filaments of the strand are sloped in a first direction and a single filament twisted with said strand in a direction opposite thereto.

U.S. Pat. No. 4,570,428 to Blackmore discloses a twin track buncher having a cradle upon which is supported two wire receiving bobbins, and wire guides at axial ends of the buncher for receiving and guiding two separate groups of wires in combination with a transverse mechanism laying each group of wires onto a respective bobbin.

U.S. Pat. No. 5,118,278 to Nishijima et al discloses an improvement for a twisted wire manufacturing machine, the improvement including a plurality of injection dyes provided with means to increase the injection resistance of raw wires so as to cause an injection speed of a core wire injected from the injection dye to be slower than the speed of the outer layer raw wires injected from the injection dyes.

Japanese Patent No. 2,717,396 to Suzuki discloses a flyer bow for a wire twisting machine having an oil extractor hole formed in a central portion of the bow's main body to prevent contaminated machine oil from adhering to the wire passage at the bow.

Japanese Patent No. 2,542,545 to Suzuki discloses a flyer bow for a wire twisting machine consisting of hard resin plates laminated and fastened to the surfaces of the flyer bow main body formed by bending a band-form metal plate into an arch shape such that the laminations being performed are done in such a way that the side edge corner portions protrude from the flyer bow main body.

Japanese Patent Application Publication No. 8-6269 to Suzuki discloses a flyer bow for a wire twisting machine consisting of a main body portion having cutouts along edges thereof, and bow auxiliary plates on which projections are formed that engage with the cutouts to be coupled to the body portion. A plurality of wire guides are disposed in a row along a center line of the flyer bow in the areas of the above mentioned plates. The construction is designed to prevent the bow from breaking with a wire twisting machine operated at high speed.

While many of the variations of wire twisting machines are known, the usual apparatus provides a constant continuous number of twists over a given length of a pair of wires which results in undesirable limitations. There is a need for a system and method that provide a continuously varying random lay of twisted wires which results in an improvement in the electrical characteristics of the cable construction.

OBJECTS AND SUMMARY OF THE INVENTION

It is therefore the primary object of the present invention to provide an improved wire twisting machine producing pairs of twisted wires forming cables having enhanced electrical characteristics.

It is another object of the invention to provide a twisted pair of insulated wires having a randomly varying lay which improves the frequency response characteristics of the wires.

It is a further object of the invention to provide a randomly varying lay of a twisted pair of wires which reduces the effects of periodic anomalies in a cable resulting in an improvement in electrical characteristics.

A still further object of the present invention is to provide a method for producing a randomly varying lay of twisted wires which produces wire cables of improved electrical characteristics.

Yet another object of the invention is to provide a novel system for automatically controlling and applying a randomly varying lay to a pair of insulated wires which are twisted together.

An additional object of the invention is to provide a novel system which automatically applies a randomly varying signal to control the take-up speed of the twisted wires with respect to the bow winding speed to provide a randomly varying lay to the twisted wires.

It is also an object of the present invention to provide a computer controlled system which generates a randomly varying signal applied to the wire twisting mechanism to produce a randomly varying lay to the pair of twisted wires.

An added object of the present invention is to provide a separate drive source for the incoming bow wire twisting mechanism and for the capstan wire winding mechanism.

These objects are achieved with a novel system for twisting wires wherein a computer generated randomly varying signal is applied to a stepping motor which drives the capstan and take-up reel for the wire separately from the wire twisting bow mechanism operating at a different relative speed. The control system receives a bow speed signal which is randomized between a minimum and maximum range to generate a computer controlled signal applied to an oscillator which provides a varying direct voltage to the stepping motor through slip rings on the drive shaft. This varies the capstan speed to provide a randomly varying wire lay.

Other objects and advantages will become apparent from the following description taken in conjunction with the accompanying drawings.

DESCRIPTION OF THE PREFERRED EMBODIMENT

Figure 1:
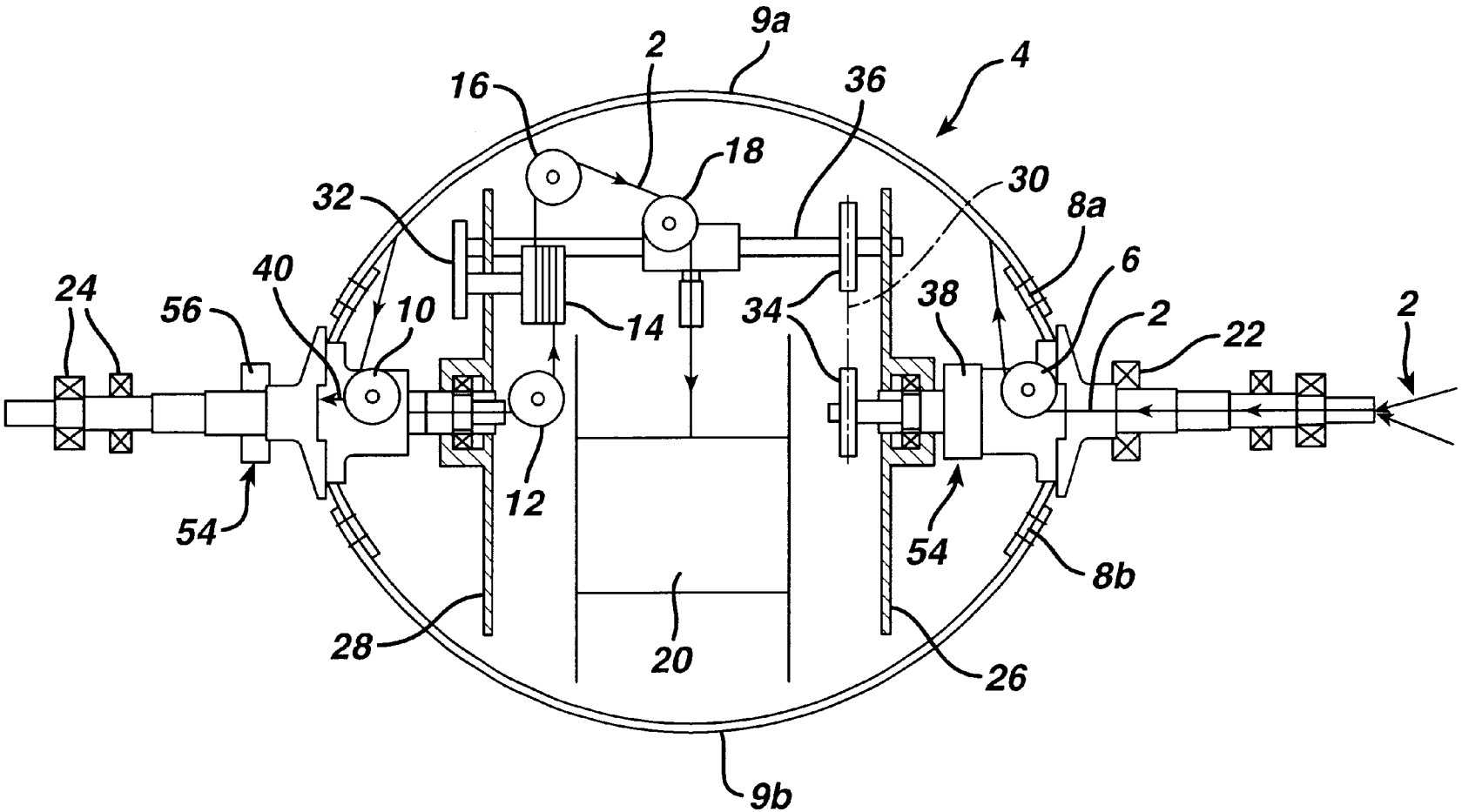
FIG. 1 is a schematic illustration of the wire twisting apparatus of the present invention.

As shown in FIG. 1, a typical pair of insulated wires 2, which are to be combined with a plurality of such wire pairs to form a wire cable, are fed into a wire twisting machine 4. The wires are directed around a first pulley 6 toward an upper bow flyer 8*a* and into a bow 9*a* which provides a first twist to the wires as the bows are rotated. A lower bow flyer

8*b* and bow 9*b* are used to balance the winding operation and prevent tangling but do not transport the wires. A second twist of the wire is applied as the wires pass over a second pulley 10. The wires then pass over another pulley 12 and are helically wound around a capstan 14. Additional pulleys 16, 18 then direct the twisted wires onto a take-up drum 20. A suitable drive motor, not shown, connected at the input side through gearing and bearings 22 and at the output side through bearings 24, provides power to drive the pair of bows 9a and 9b connected between the input and output sides. Supporting discs 26,28 within the bow area support the various drive elements including belts 30,32 pulleys 34, transmission shaft 36 and capstan 14.

In the present configuration, an added stepping motor 38 is positioned within the bow area in place of fixed gearing to provide a separate drive for the capstan and take-up drum, while the bows are driven by the normal drive motor. The normal lay of the twisted wires is determined by the rotational speed of the flyer bow and the pull speed of the wires which provides a number of turns or twists per unit length of the wire. The pull speed of the wire is determined by the rotational speed and diameter of the capstan. Therefore, by using the stepping motor to vary the speed of the capstan, the lay of the wire, or number of twists per unit length, will be determined by the speed of the capstan motor, assuming that the bow is rotating at a constant velocity. By applying a randomly varying control signal within certain limits to control the speed of the stepping motor with respect to the independently generated bow speed, a random lay cycle or lay length is generated for the twisted wire.

Figure 2:
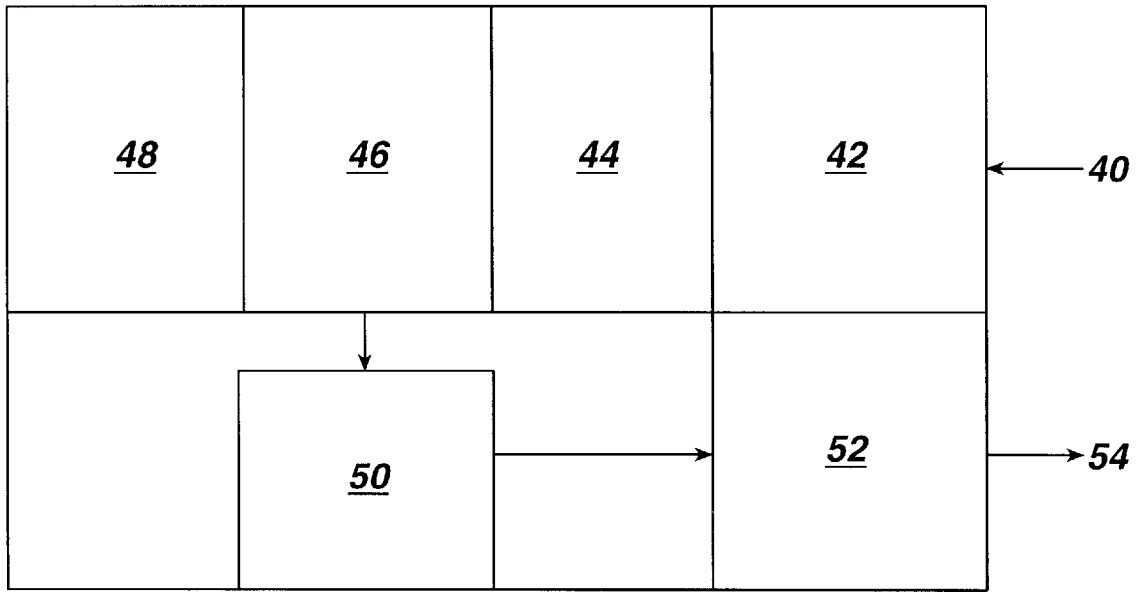
FIG. 2 is a block diagram of the control system of the present invention.

The random variation in the capstan speed is achieved with a novel control system as shown in the block diagram of FIG. 2. A signal representing bow speed 40 is sensed by a suitable pick-up device from pulley 10, or other suitable sensing locations, and fed into an analog output module 42 which provides a proportional signal frequency. The analog output signal is fed into a basic module 44 which generates a random number within a given range of a minimum of 0 to a maximum of 65,536, as a specific example. This number is normalized by a programmed central processing unit 46 to provide a random signal representative of a varying length of lay in a range of from 0.2 –0.9 inches in this instance. A local power supply unit 48 provides power to this control system. The random lay signal from central processing unit 46 is fed into an oscillator circuit 50 which provides a varying frequency signal to a battery or power supply unit 52. Unit 52 provides a pulsed direct voltage signal 54 to control the stepping motor 38. Signal 54 is fed through slip rings 56 on the drive shaft which couples the control signal to provide power to the stepping motor modulated by the random lay signal. The result is the randomly varying lay length of turns of wire between the designated minimum and maximum lengths that are wound on take-up drum 20.

While only a single pair of wires is shown being wound with a randomly varying lay, like mechanisms may be used in parallel to wind additional pairs which are then twisted together to form a cable having a plurality of such pairs. For example, a cable may include two to six such pairs.

Figure 3:
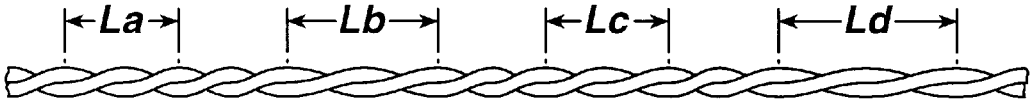
FIG. 3 is a representative illustration of a length of a pair of twisted wires built in accordance with the teachings of the present invention showing a pair of twisted wires having a varying length of lay.

FIG. 3 illustrates a section of twisted wires produced by the apparatus of FIG. 1. Randomly varying lengths of lay La, Lb, Lc and Ld are indicated at different positions along a typical length of wire.

Figure 4:
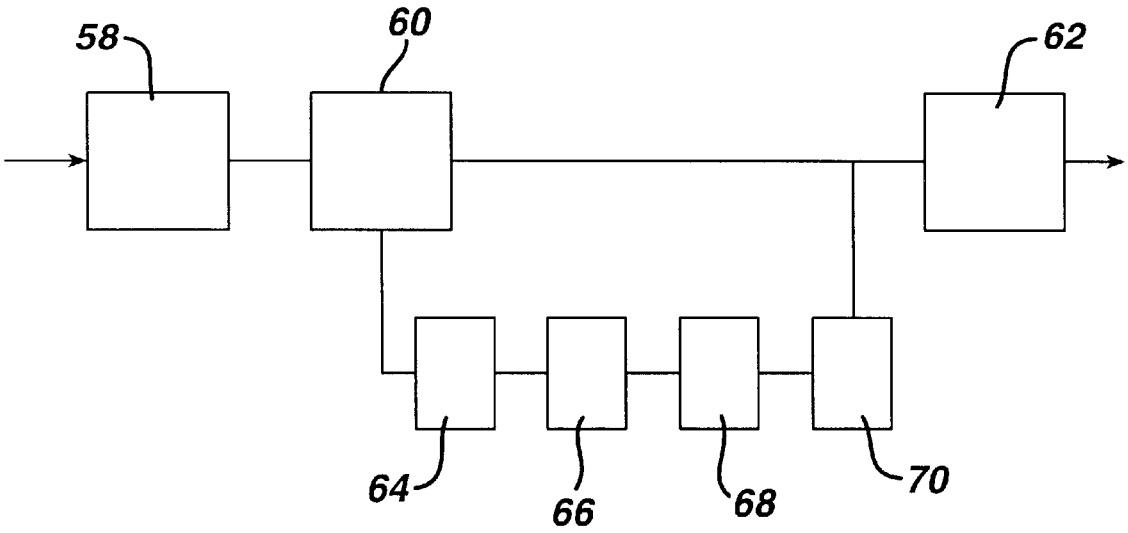
FIG. 4 is a block diagram indicating the sequence of operation for the wire twisting method.

The various steps in the method of forming the random lengths of lay of the twisted wires are shown in FIG. 4. The pair of wires are fed at 58 into the wire twisting apparatus and are twisted together at 60 at a predetermined rate of speed. The twisted wires are directed at 62 onto a take-up drum. The rate of speed of the wire twisting is sensed at 64, a signal frequency proportional to the speed is generated at 66, the signal is converted at 68 into a randomly varying control signal within a given range representative of a varying length of lay within given limits, and the randomly varying control signal is applied at 70 via a stepping motor to the twisted wires directed onto the take-up drum at a varying speed different from the original predetermined speed to cause the twisted wires to have the randomly varying length of lay between predetermined limits.

The constantly varying lengths of lay between twisted pairs of wires has significant performance advantages in reducing structural return losses due to defects and periodic anomalies in cables having many such pairs. The process also increases headroom or the distance between the frequency response of a cable at a test frequency and the maximum limit for the cable design. This permits the cables to operate at higher frequencies. While the present method provides a system for randomizing the lay length of a twisted pair of wires over a given length, it is also possible to achieve a like effect as a function of time.

While only a limited number of embodiments have been illustrated and described, other variations may be made in the particular configuration without departing from the scope of the invention as set forth in the appended claims.

What is claimed is:

1. Apparatus for twisting wires comprising:

means for feeding a pair of insulated wires into a wire twisting machine;

means for twisting said wires together at a constant speed to form a wire lay; winding means for receiving and winding the twisted wires;

first drive means for driving said twisting means;

means for sensing the rate of speed of the wires being twisted;

means for generating a frequency signal proportional to said rate of speed;

means for receiving said signal and generating a randomly varying signal representative of a varying length of lay within predetermined limits;

means for generating a control signal from said randomly varying signal; and second drive means for receiving said control signal and applying said control signal to said winding means to randomly vary the length of lay of the pair of twisted wires wound on said winding means.

2. The apparatus of claim 1 wherein:

said means for twisting said wires includes a pair of opposed bows, one of said bows carrying said pair of wires, said winding means includes a capstan and take-up drum, and said second drive means includes a stepping motor and slip rings applying said control signal to said stepping motor.

3. The apparatus of claim 2 wherein:

said means for generating a frequency signal includes an analog output module, said means for generating a random signal includes:

a basic module generating a random number within predetermined limits, a central processing unit providing a random signal from said random number representing a varying length of lay, said means for generating a control signal includes an oscillator providing a varying frequency signal, and means receiving said control signal and supplying a varying direct voltage signal to said stepping motor.

4. The apparatus of claim 3 wherein said stepping motor applies said control signal to said winding means independent of the rate of the rotational speed of the wires being twisted.

5. The apparatus of claim 4 including a plurality of like apparatus twisting together a plurality of pairs of wires each having a randomly varying length of lay to form a cable.

6. The apparatus of claim 4 wherein said pair of insulated twisted wires has a randomly varying length of lay of between 0.2 to 0.9 inches.

7. Apparatus for twisting wires comprising:

means for feeding a pair of insulated wires into a wire twisting machine, means for twisting said wires together at a constant rotational speed to form a wire lay, first drive means for driving said twisting means, means for drawing said twisted wires at a takeup speed from said means for twisting said wires, means for winding said twisted wires, means for sensing said takeup speed and generating a frequency signal proportional to said takeup speed, means for receiving said signal and generating a randomly varying signal representative of a varying length of lay within predetermined limits, means for generating a control signal from said randomly varying signal, and second drive means for receiving said control signal and applying said control signal to said winding means to randomly vary the length of lay of the pair of twisted wires wound on said winding means.

8. A method of twisting pairs of insulated wires including the steps of:

feeding a pair of insulated wires into a wire twisting apparatus, twisting the wires together at a predetermined rate of rotational speed to form a wire lay, drawing the twisted wires, directing the twisted wires onto a takeup means, generating a randomly varying control signal representative of a varying lay length within predetermined limits, and applying said control signal to automatically vary the takeup speed of the twisted wires to produce a randomly varying lay.

9. The method of claim 8 wherein said generating a randomly varying control signal and applying said control signal includes:

sensing the speed of the wires twisted onto the takeup means, generating a frequency signal proportional to the rate of speed, generating a control signal from said frequency signal, and applying said control signal to the twisted wires directed onto said takeup means at a varying speed different from said predetermined rate of speed to randomly vary the length of lay of the pair of twisted wires within predetermined limits.

10. The method of claim 8 wherein said step of generating a randomly varying control signal and applying said control signal includes:

generating a randomly varying number within predetermined limits, generating a randomly varying signal from said randomly varying number representing a varying length of lay, generating a frequency signal from said randomly varying signal, converting said frequency signal into a varying direct voltage signal, and applying said direct voltage signal to a driving motor to control the speed of the wires directed onto the takeup means to provide said randomly varying length of lay between said limits.

11. A pair of insulated twisted wires having a randomly varying length of lay made by the method of claim 8.

12. Apparatus for twisting wires, comprising;

means for feeding a pair of insulated wires into a wire twisting machine, means for twisting said wires together at a constant rotational speed to form a wire lay, takeup means for receiving and winding the twisted wires, and means for forming a randomly varying length of lay within predetermined limits including means coupled to said takeup means for automatically providing a randomly varying takeup speed for said wires.

13. The apparatus of claim 12 wherein said means providing a randomly varying takeup speed includes computer generator means generating random control signals controlling said takeup speed of the wire.

14. A method of twisting pairs of insulated wires including the steps of:

feeding a pair of insulated wires into a wire twisting apparatus, twisting the wires together at a first rate of speed to form a wire lay, drawing the twisted wires onto a takeup means, and randomly varying the takeup speed of the twisted wires to randomly vary the length of lay.

* * * * *